US006991454B2

(12) United States Patent
Gore et al.

(10) Patent No.: US 6,991,454 B2
(45) Date of Patent: Jan. 31, 2006

(54) GAS BURNER

(75) Inventors: Hardial S. Gore, Buena Park, CA (US); Depinder Paul, Cerritos, CA (US)

(73) Assignee: Lennox Hearth Products, Inc., Richardson, TX (US)

( * ) Notice: Subject to any disclaimer, the term of this patent is extended or adjusted under 35 U.S.C. 154(b) by 110 days.

(21) Appl. No.: 10/662,916

(22) Filed: Sep. 15, 2003

(65) Prior Publication Data

US 2004/0067462 A1 Apr. 8, 2004

Related U.S. Application Data

(62) Division of application No. 09/808,819, filed on Mar. 15, 2001, now abandoned.

(51) Int. Cl.
*F23D 14/12* (2006.01)
*F24C 3/00* (2006.01)

(52) U.S. Cl. ..... 431/328; 431/7; 431/326; 126/92 R

(58) Field of Classification Search ..... 431/125, 431/126, 326, 328, 7.17; 126/92 R, 92 AC, 126/91 R, 512, 85 R, 85 B; 239/397.5, 424, 239/132.3, DIG. 19; 29/890.02, 527.2, 527.4; 264/239–250, 255, 256, DIG. 57
See application file for complete search history.

(56) References Cited

U.S. PATENT DOCUMENTS

| | | | | | |
|---|---|---|---|---|---|
| 4,917,599 | A | * | 4/1990 | Hasselmann | 431/328 |
| 5,057,006 | A | * | 10/1991 | Follert et al. | 431/328 |
| 5,601,073 | A | * | 2/1997 | Shimek | 126/512 |
| 5,941,459 | A | * | 8/1999 | Brooker et al. | 239/397.5 |
| 6,443,726 | B2 | * | 9/2002 | Atemboski et al. | 431/125 |

FOREIGN PATENT DOCUMENTS

| | | | | |
|---|---|---|---|---|
| EP | 521833 | * | 1/1993 | 431/328 |
| GB | 2067951 | * | 9/1981 | 431/328 |
| JP | 58-49815 | * | 3/1983 | |
| JP | 9-14615 | * | 1/1997 | 431/326 |

OTHER PUBLICATIONS

Stoves, Home Technology, Popular Science, Oct. 2000, p. 30.

* cited by examiner

*Primary Examiner*—James C. Yeung
(74) *Attorney, Agent, or Firm*—Christie, Parker & Hale, LLP

(57) ABSTRACT

A gas burner is provided that simulates wood burning fire and the glowing ember effect of real wood or coal burning. The burner has a burner pan which is covered by a refractory material and a ceramic material. Burner ports are formed through the refractory and ceramic materials. Methods for forming such a burner are also provided.

23 Claims, 7 Drawing Sheets

GAS BURNER

CROSS REFERENCED TO RELATED APPLICATION

The present application is a divisional application of application Ser. No. 09/808,819, filed on Mar. 15, 2001 now abandoned.

FIELD OF THE INVENTION

The present invention relates to a gas burner that simulates the glowing ember effect of wood or coal burning.

BACKGROUND OF THE INVENTION

Gas burners are currently used in many gas fireplaces in combination with artificial logs for producing flames. While the artificial logs may give the appearance of realistic real wood burning logs, in many instances, the burner itself is visible, detracting from the realistic fireplace burning appearance. As such, a gas burner is desired that provides the glowing ember effect of real wood or coal burning so as to not detract from the realistic appearance of a gas fireplace.

SUMMARY OF THE INVENTION

In one embodiment, a burner is provided having a concrete board, a ceramic board embedded in the concrete board, and a pan having a peripheral surface, wherein a portion of the peripheral surface is coupled to the concrete board, wherein the concrete board and pan define an enclosed burner and wherein the concrete defines an exposed surface of the burner.

In another exemplary embodiment a burner provided having a refractory board, a ceramic board embedded in the refractory board, and a pan having a peripheral surface, wherein a portion of the peripheral surface is coupled to the refractory board, wherein the refractory board and pan define an enclosed burner and wherein the refractory board defines an exposed surface of the burner.

In another exemplary embodiment a method for making a burner is provided. The method requires providing a mold having an inner surface having a desired shape and having at least a protrusion, placing a ceramic board having at least an opening in the mold such that the protrusion penetrates the opening, pouring a refractory material in the mold, providing a burner pan comprising a peripheral surface, embedding the peripheral surface of the pan in the refractory material, curing the refractory material forming an enclosed burner, and removing the mold.

In yet a further exemplary embodiment, a method for making a burner is provided. The method requires providing a mold having an inner surface having a desired shape, placing a ceramic board having in the mold, pouring a refractory material in the mold, providing a burner pan comprising a peripheral surface, embedding the peripheral surface of the pan in the refractory material, curing the refractory material forming an enclosed burner, and removing the mold.

DETAILED DESCRIPTION OF THE INVENTION

Figure 1:
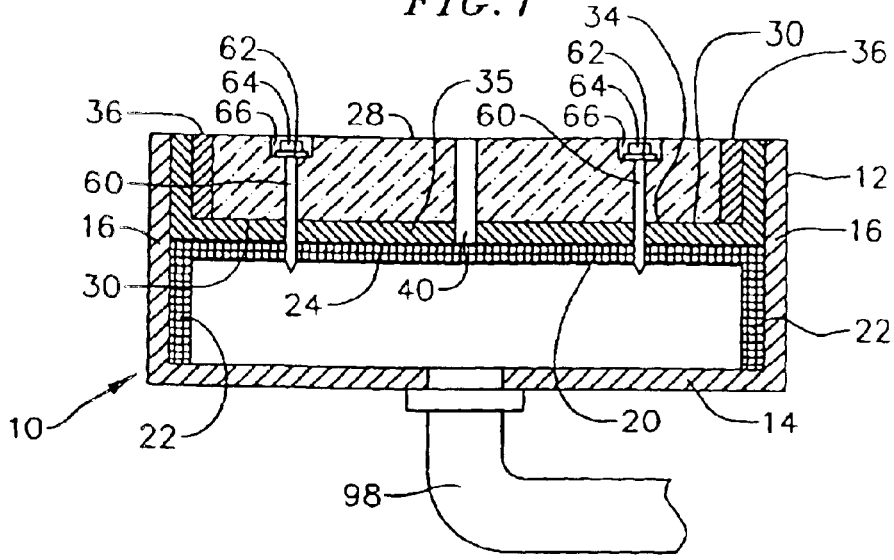
FIG. 1 is a cross-sectional view of a burner of the present invention.

A gas burner 10 is provided that simulates wood burning fire and the glowing ember effect of real wood or coal burning (FIG. 1). In an exemplary embodiment, the burner has a rectangular shaped cross-section. However, the cross-sectional shape of the burner may be round, square or a combination thereof.

Figure 2:
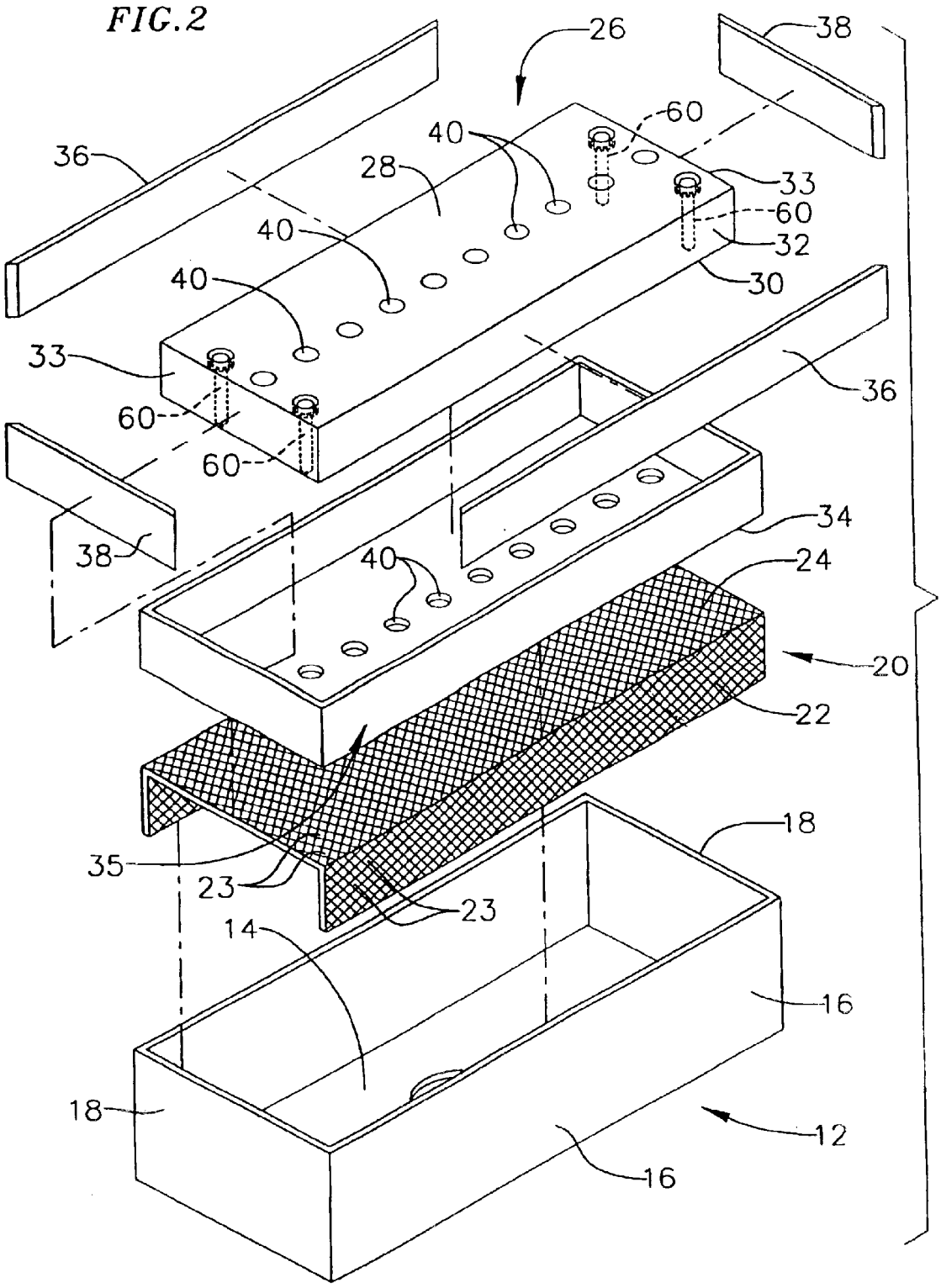
FIG. 2 is an exploded perspective view of the burner shown in FIG. 1.

In an exemplary embodiment, the burner comprises a pan 12 in the form of a rectangular open box. The pan comprises a base 14 surrounded by two opposite side walls 16 and two opposite end walls 18 (FIGS. 1 and 2). An elongate support screen 20 having a channel shaped cross-section, i.e., a U-shaped cross-section, is placed within the pan. In essence, the screen comprises two leg portions 22 and a web 24 there between. In a preferred embodiment, the U-shaped screen is formed by taking an elongated strip of screen material and bending its ends downward. When placed within the pan, the legs 22 of this screen rest against the pan base 14. The length of the screen 20 is preferably just slightly smaller than the length of the pan 12 such that when it is placed within the pan, the screen occupies almost the entire length of the pan. Preferably, the web portion of the screen is wide enough to span almost the entire width of the pan. The screen may consist of perforations 23 throughout the entire length and width of the screen, as for example shown in FIG. 2, or may include only sections of perforations surrounded by sections of solid material. The perforated sections of the screen should be positioned so as to provide a passage for the gas to flow from the pan to the burner ports.

Figure 4:
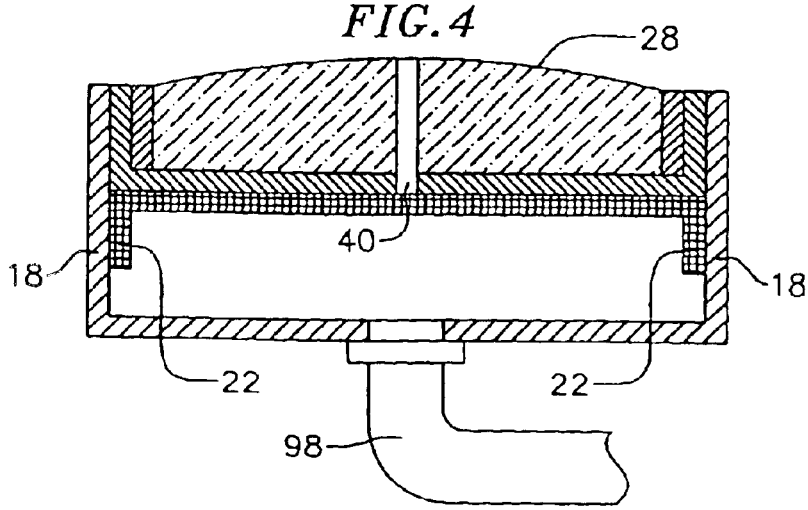
FIG. 4 is a cross-sectional view of another embodiment burner of the present invention.

A ceramic material board 26 is rested on the web 24 of the screen to form the upper surface of the burner while fully enclosing the burner. The ceramic board may have a flat upper surface 28 (FIG. 1) or a convex upper surface 28 (FIG. 4). A ceramic material board is used because it has low thermal expansion, can withstand high temperatures, and has an irregular surface which can be easily modified to simulate coal or wood burning embers.

The ceramic board comprises an upper surface 28, a lower surface 30, and side edge surfaces 32 and end edge surfaces 33 between the upper and lower surfaces (FIGS. 1 and 2).

The terms "upper," "lower," "upward" and "downward" as used herein are relative terms and do not necessarily denote the actual position of an element. For example, an "upper" member may be located lower than a "lower" member.

In one embodiment, the ceramic board lower surface 30 and side and end edge surfaces 32, 33 are wrapped with a heat and flame resistant material 34 forming a covering 35. Preferably an aluminum foil having a thickness of preferably 2 to 13 mils is used to form the covering 35. Aluminum foil is the preferred covering for the ceramic board, because it is easily pliable to a desired shape and it can be easily cut and drilled to form the gas ports 40. When the ceramic board is rested on the screen, the lower surface 30 of the ceramic board covered with the covering faces toward the screen.

If the covering is made from a non-weldable material, e.g., aluminum foil, then strips 36 of a weldable material, as for example steel, are placed along the side edge surfaces 32 of the ceramic board for providing weldable surfaces. Weldable strips 38 are also placed along the end edge surfaces 33 of the ceramic board. The covering 35 is wrapped over the metal strips 36, 38. The covering and weldable strips 36, are spot welded to the side walls 16 and end walls 18 of the pan thereby forming a sealed enclosure with the pan. In such case, during welding, the non-weldable material, e.g., the aluminum, the weldable strips and the side and end walls of the pan flow and mix with each other such that when they cool, the strips (if used) and pan side and end walls are welded to each other.

If the covering 35 is made from a weldable material, as for example steel, the covering is spot welded to the side walls 16 and end walls 18 of the pan thereby forming a sealed enclosure with the pan. A heat and flame resistant sealant may also be applied between the board, covering, strips and pan walls to provide a further seal at the interface between the board and the pan walls.

Burner ports 40 are formed through the ceramic board and through the covering to allow for the gas to escape there through. The size and location as well as density of the ports in the in the covering and board can be tailored so as to create different flame patterns.

In an alternate embodiment, instead of spot welding the covering 35 to the pan side and end walls, the covering may be attached to the side and end walls of the burner pan using a suitable adhesive. Sheet metal screws (not shown) may also be used which penetrate through the metal strips if incorporated. If the covering is adhered to the walls of the pan, then weldable strips are not necessary.

Applicant has discovered that a better seal can be obtained between the ceramic board and the walls of the burner pan by tying the ceramic board to the screen. Specifically, applicant has discovered that by screwing the ceramic board to the screen web, better sealing was achieved. Preferably four screws 60 such as sheet metal screws are screwed through the thickness of the ceramic board and into the screen web tying the ceramic board to the screen (FIGS. 1 and 2). A washer 62 is preferably used with each screw such that the washer is sandwiched between the head 64 of each screw and the ceramic board for providing support to the screw head. Preferably, countersinks 66 are formed to accommodate the screws so that the heads are flush with the upper surface of the ceramic board.

In a preferred embodiment, the ceramic board, has a density of preferably 16 lb. per cubic foot, and a thickness of about half inch thick. Once cut to the desired size, the ceramic board is dipped into a colloidal silica solution to get more strength. The board is then dried into an oven for about one to two hours at about 500□F. The covering is preferably adhered to the ceramic board using an adhesive.

In an alternate embodiment, the density of the ceramic board may be made to vary through its thickness. Preferably, the upper surface of the board is made to have a lower density while the lower surface if the board is made to have a higher density. Preferably, the density of the upper surface of the ceramic board is as low as possible such that it can glow when subjected to heat. An exemplary board may be made by positioning a lower density board on top of a higher density board.

In a one embodiment, the exposed surface of the ceramic board is carved into small uneven sections, preferably having a size of about ½"×½", with each carving having a depth of about 3⁄16". After a desired carved pattern is achieved on the ceramic board, ports may then be drilled on the board and covering if so desired. When heated, the carvings provide the appearance of ashes.

Figure 3:
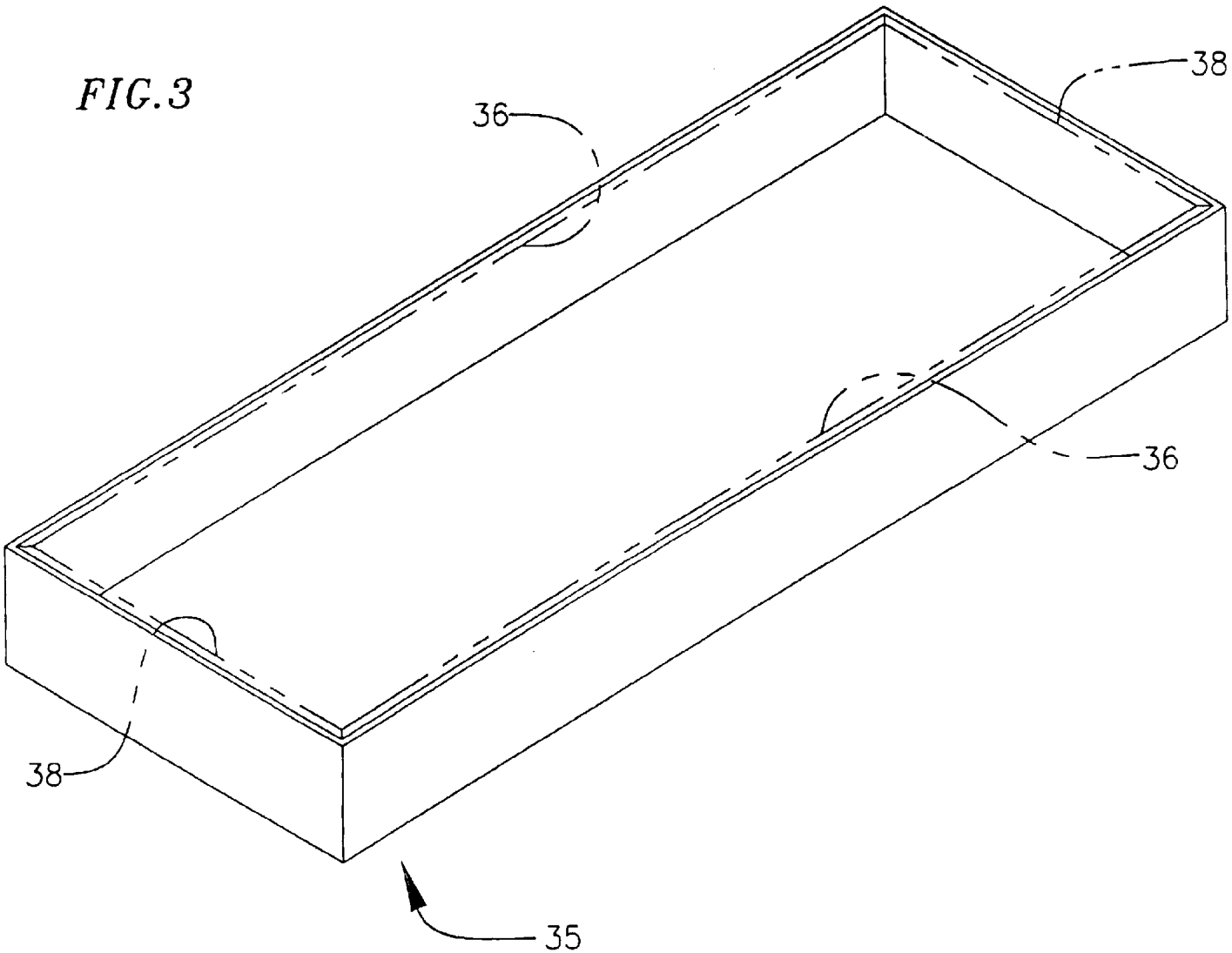
FIG. 3 is a perspective of a covering used to cover the ceramic board used in the burners of the present invention.

In a further alternate embodiment, the covering 35, is formed in the shape of a pan 42 (FIG. 3). If the covering is made from aluminum foil, weldable material strips 36, 38 are then placed within the pan shaped covering along the inner walls of the shaped pan. Alternatively, a weldable material frame, as for example a steel frame, may be used instead of the strips. Ceramic material is then poured within the confines of the foil pan and then baked to form the ceramic board. Ports are formed as necessary though the covering and through the thickness of the ceramic material.

Figure 5:
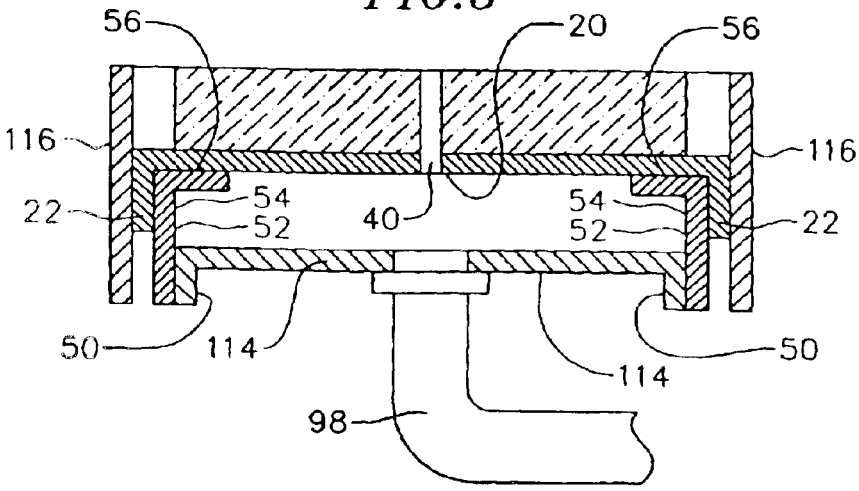
FIG. 5 is a cross-sectional view of a further embodiment burner of the present invention.

In an alternate embodiment, the screen legs 22 may be attached to the side walls 18 of the burner pan without contacting the base of the pan as shown in FIG. 4. In yet a further embodiment, support brackets may be formed extending from a base 114 of a pan as shown in FIG. 5. The screen 20 is then attached to the support brackets. When the brackets are extending from the base of the burner pan, the screen 20 having a cross-sectional channel shape may be mounted over the brackets such that each leg 22 of the screen is fitted between a bracket 52 and a burner pan side wall 116. In the exemplary embodiment shown in FIG. 5, a pan is formed from separate side walls 116 and a separate base 114. The base 114 has two legs 50 extending from the ends of the base, each leg spanning the length of the base. The two legs are preferably formed by bending the opposite end portions of the base. An L-shaped bracket 52 comprising a first leg 54 and a second leg 56 perpendicular to the first leg is attached between each base leg 50 and each side wall 116. Specifically, the first leg 54 of each bracket is sandwiched between a base leg 50 and a side wall 116 such that the second leg 56 of each bracket extends in a direction away from its corresponding side wall. Each leg 22 of the support screen is sandwiched between the bracket leg 52 and its corresponding side wall 116. Each side wall 116, corresponding bracket first leg 54 and corresponding base leg 50 are welded or otherwise attached together forming the pan with a mounted screen.

In yet a further alternate embodiment, the base of the burner pan may be formed separate from the side and end walls of the base. The sides and end wall are then attached to the base to form the pan. For example, the side walls and end walls may form an integral frame to which is attached a base to form the burner pan. Alternatively, each side wall or end wall is separately attached to the base.

Figure 6A:
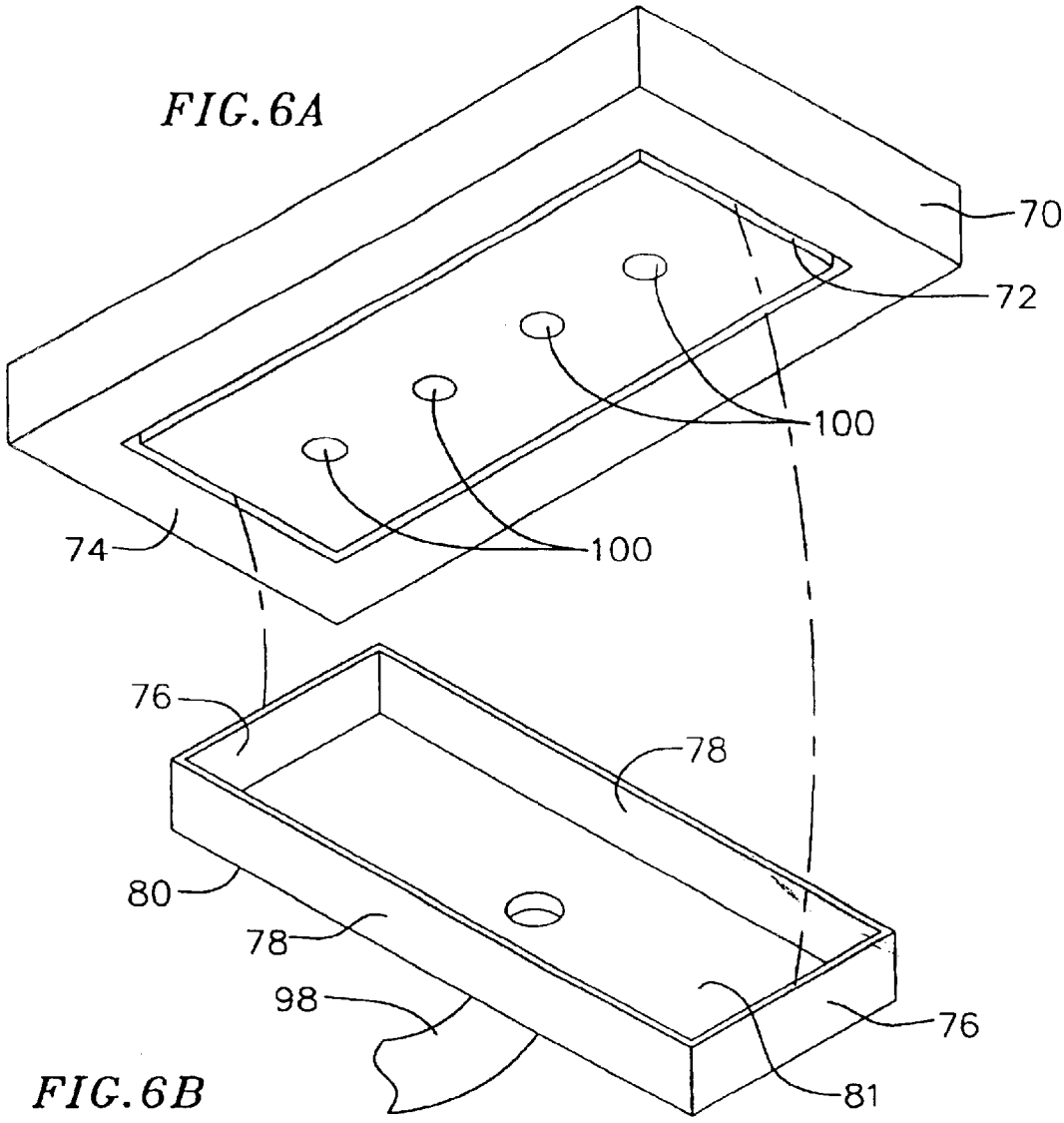
FIG. 6A is a an exploded view of an open embodiment burner of the present invention.
Figure 6B:
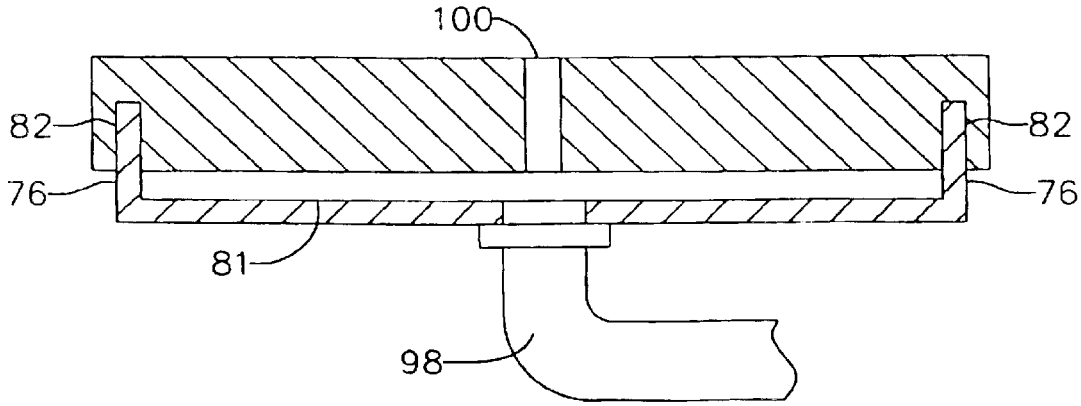
FIG. 6B is a cross-sectional view of the embodiment shown in FIG. 6A.

In another embodiment, a ceramic board 70 is formed having a slot 72 on its bottom surface 74 defining a shape complementary to the shape defined by the end walls 76 and side walls 78 of a burner pan 80 (FIGS. 6A and 6B). The ceramic board is fitted over the burner pan such that the end and side walls of the pan are fitted within the slot. A ceramic adhesive (or silicone) 82 is preferably placed within the slot prior to installation of the board over the pan. An adhesive is preferably used to bond the ceramic board to the walls of the pan and to seal the interface between the ceramic board and pan to prevent leakage of the gas through the interface. With this embodiment, the depth of the slot should be shorter than the height of the walls so that the lower surface 74 of the board does not rest against the base 81 of the pan 80.

For a tighter fit, it is preferred that each section of the slot interfacing with a wall of the pan has a shape complementary to that wall and a thickness slightly greater than the thickness of the wall. The slot can be formed by machining after formation of the board and may be formed during manufacture by forming the board using an appropriate mold.

Figure 7:
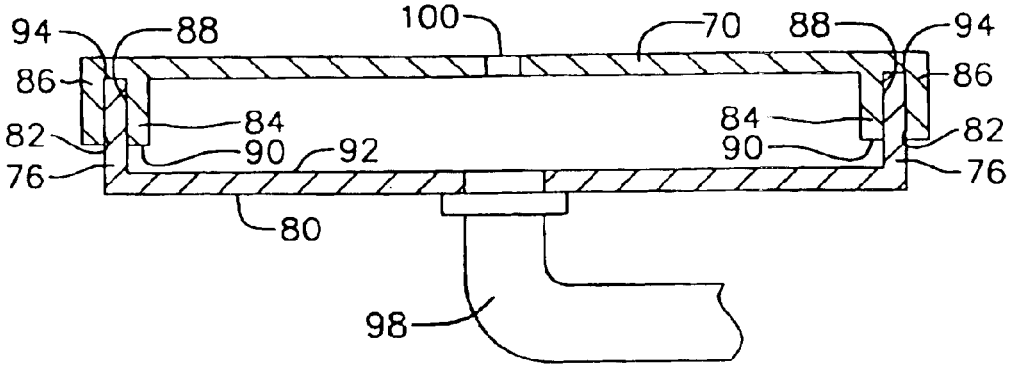
FIG. 7 is a cross-sectional view of another embodiment of the present invention.

In an alternate embodiment shown in FIG. 7, the board is formed having a pair of legs, i.e., an inner leg 84 and an outer leg 86 defining a slot 88 there between for accommodating the walls of the pan. The slot has a shape complementary to the shape defined by the end walls 76 and side walls 78 of the burner pan. For example, if the walls of the burner define a rectangle than the slot 88 defines a rectangle wherein each side of the rectangular slot accommodates a wall of the burner pan. Alternatively four sets of leg pairs are formed extending from the ceramic board such that each set forms a slot for accommodating one of the walls of the burner pan.

The ceramic board is mounted over the pan burner 80 such that the walls are fitted within the slot(s), i.e., such that the legs of the board straddle each wall. With this embodiment, the board may be made to rest against the end and side walls by forming the slot(s) 88 with a depth that is shorter than the height of the burner pan end and side walls. In this regard, the base(s) 94 of the slot(s) 88 will rest against the end and side walls of the burner pan. Alternatively, the ceramic board may be made to rest against the base of the pan by having the base(s) 90 of the inner leg(s) 84 rest against the base 92 of the burner. This can be accomplished by forming the slot(s) 88 with a depth at least as high as the height of the end and side walls of the burner pan.

Figure 8:
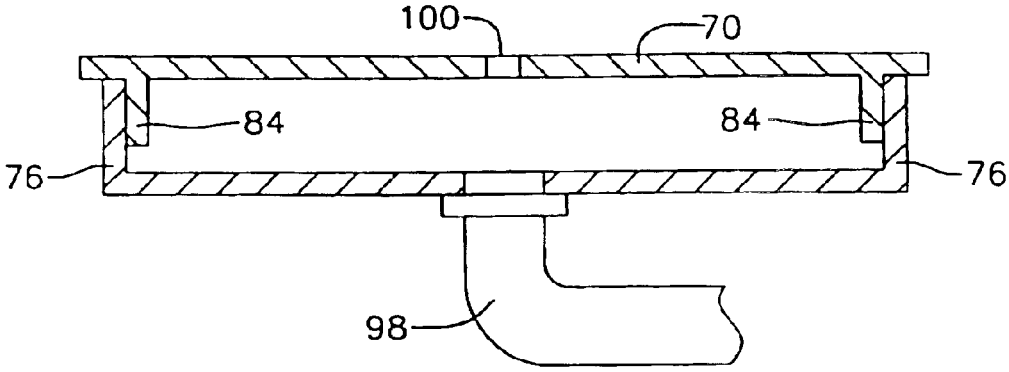
FIG. 8 is a cross-sectional view of yet another embodiment burner of the present invention.

In a further alternate embodiment shown in FIG. 8, the board 70 if formed with only the inner leg(s) 84. With this embodiment, when the board is mounted over the end walls 76 and side walls 78 of the burner pan, the inner leg(s) is (are) adjacent and interior to the burner pan walls. The leg(s) is (are) preferably bonded to the pan walls using a ceramic adhesive or silicone.

Figure 9:
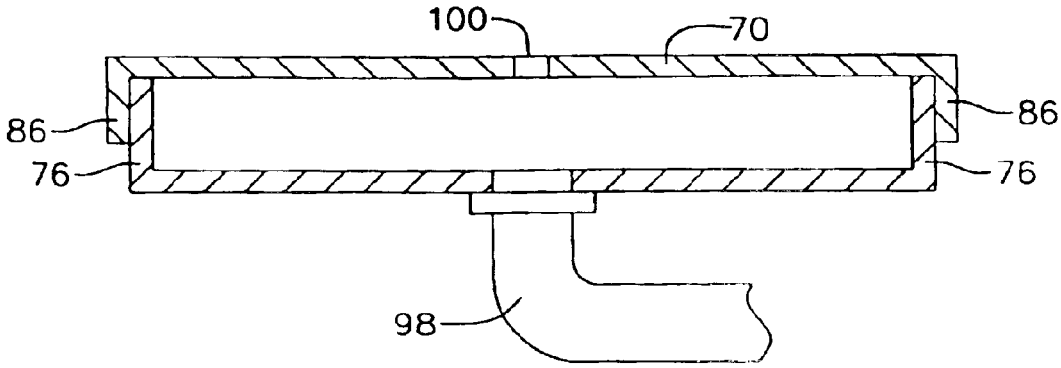
FIG. 9 is a cross-sectional view of yet further embodiment burner of the present invention.

In yet a further alternate embodiment shown in FIG. 9, the board 70 if formed with only the outer leg(s) 86. With this embodiment, when the board is mounted over the end walls 76 and side walls 78 of the burner pan, the outer leg(s) is (are) adjacent and exterior to the burner pan walls. The leg(s) is (are) preferably bonded to the pan walls using a ceramic fiber adhesive.

With the embodiments shown in FIGS. 6–9 burner ports 100 are formed through the ceramic board. The size and location as well as density of the ports in the board can be tailored so as to create different flame patterns.

Figure 10:
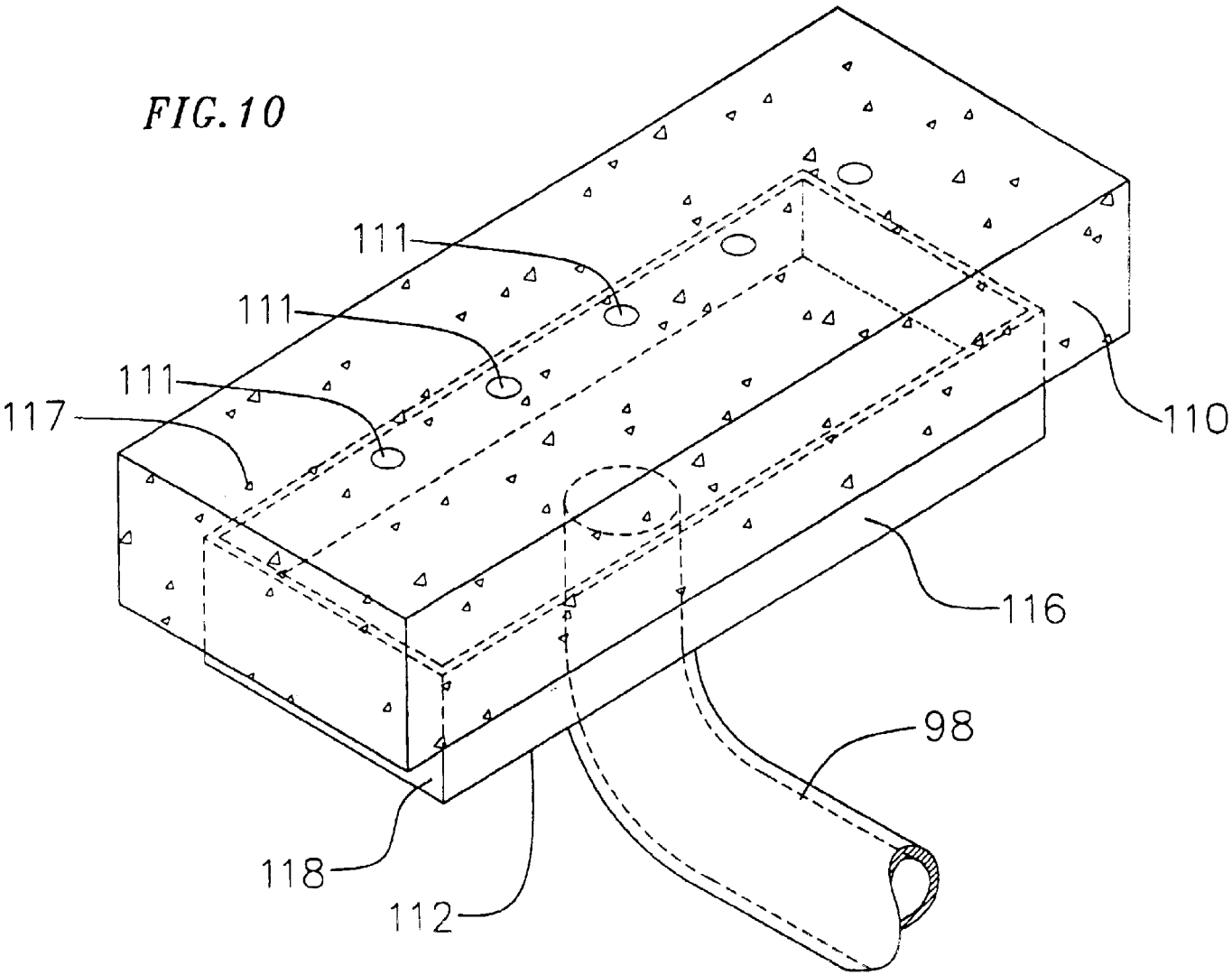
FIG. 10 is a perspective view of an alternate embodiment burner of the present invention having a concrete upper portion.
Figure 11:
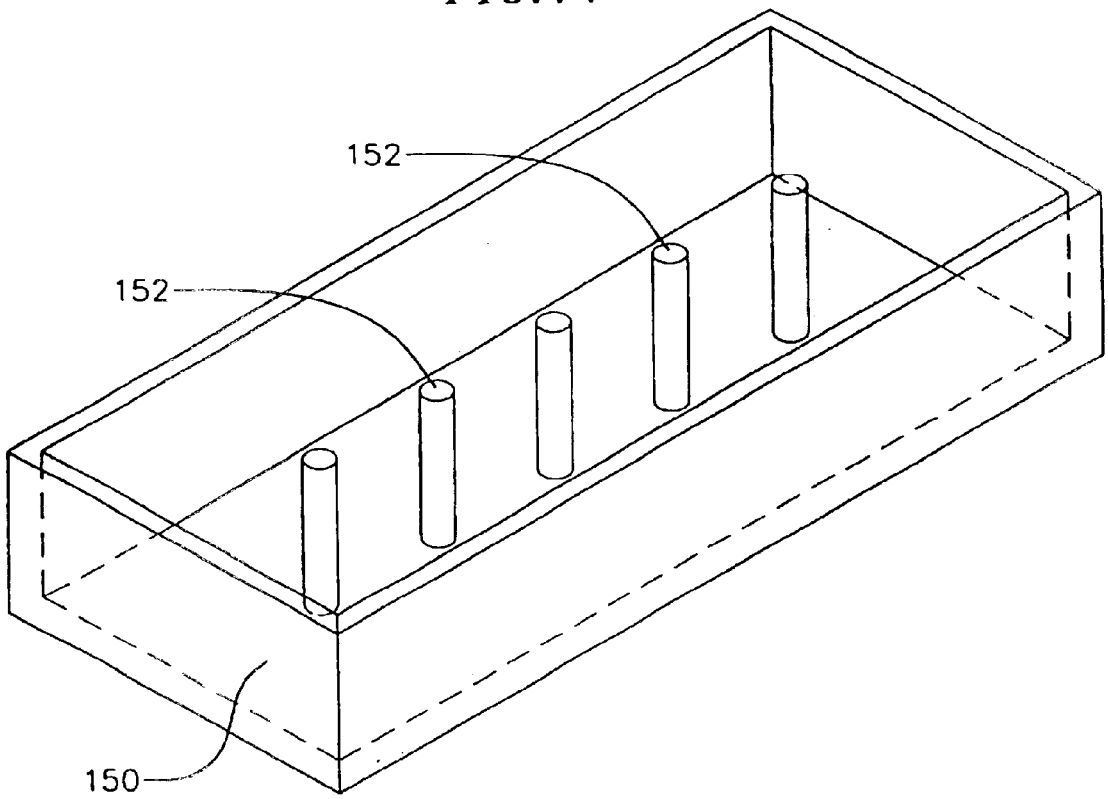
FIG. 11 is a perspective view of an exemplary mold used to form the concrete upper portion of the burner shown in FIG. 10.

In another embodiment, the burner may be formed with a concrete board 110 as shown in FIG. 10. To burner concrete board is formed in a mold 150 as for example shown in FIG. 11. The mold has port forming members 152 as for example cylindrical members which are used to form the ports 111. The geometry of the ports formed on the concrete board is controlled by the geometry of the port forming members. Concrete is poured on the mold to a level lower than the height of the port forming members. Before the concrete cures, a burner pan is pushed into the concrete such that the end walls 116, 118 of the pan are immersed into the concrete. When the concrete cures it is removed from the mold and forms a concrete board attached to the burner pan defining a burner. The concrete board upper surface 117 defines a surface of the burner.

The concrete may be of the same type that is used to form the walls of the combustion chamber of a fireplace. In this regard the concrete board 110 may be used to form a wall of the combustion chamber as for example the combustion chamber floor. As such, the burner will be hidden from view when used in a fireplace. In the exemplary embodiment shown in FIG. 10, the concrete comprises gravel, sand and cement.

Figure 12:
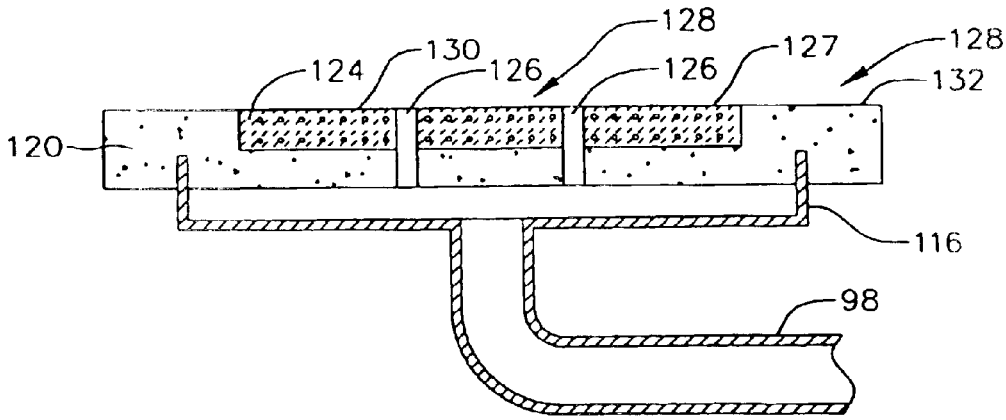
FIG. 12 is a perspective view of a further alternate embodiment burner of the present invention.

In yet another embodiment as shown in FIG. 12, the burner is formed with a concrete board 120 on which is embedded a ceramic board 124. With this embodiment, a ceramic board is formed with the requisite ports 126. The ceramic board is then fitted in the mold such that the mold port forming members penetrate the ceramic board ports 126. Concrete is then poured in the mold such that it surrounds the concrete board. The concrete is poured to a level lower than the level of the port forming members. Before the concrete cures, a burner pan is pushed into the concrete such that the end walls 116, 118 of the pan are immersed into the concrete. When the concrete cures it forms the concrete board—having an embedded ceramic board having an exposed surface 127—attached to the burner pan defining a burner. The upper surface 128 of the defined burner has a ceramic portion 130 surrounded by a concrete portion 132.

The concrete board exposed surfaces 117, 132 of the burners disclosed in FIGS. 10 and 12, respectively may be made to be rough or smooth.

In yet further alternate embodiments, instead of using concrete, the embodiments shown in FIGS. 10 and 12 may be formed with a refractory adhesive.

With each of the aforementioned embodiments, a gas adapter 98 is attached to the burner pan, preferably at the base of the burner pan or through a side wall of the pan for providing gas to the burner. Gas enters the burner pan through the adapter and escapes through the ports defined on the ceramic board for forming a flame pattern.

To vary the desired pattern of coal simulation, the depth or thickness of the ceramic board may be varied along its length and width. Moreover, by adjusting the air that is provided to the burner, the burner may be made to produce a range of effects from a red hot coal look to a yellow flame.

Although the present invention has been described and illustrated to respect to multiple embodiments thereof, it is to be understood that it is not to be so limited, since changes and modifications may be made therein which are within the full intended scope of this invention as hereinafter claimed.

What is claimed is:

1. A burner comprising:

a concrete board;

a ceramic board embedded in the concrete board;

at least one port formed through at least one of said concrete and ceramic boards;

a pan comprising a peripheral surface, wherein a portion of the peripheral surface is coupled to the concrete board, wherein the concrete board and pan define an enclosed burner and wherein the concrete board defines an exposed surface of the burner; and an inlet on said burner for receiving a fuel.

2. The burner as recited in claim 1 wherein a surface of the ceramic board is exposed.

3. The burner as recited in claim 1 wherein the peripheral surface is embedded into the concrete board.

4. The burner as recited in claim 1 wherein the concrete board comprises ports formed though the concrete board.

5. The burner as recited in claim 1, wherein the ceramic board comprises ports formed through the ceramic board thickness.

6. The burner as recited in claim 5 wherein the concrete board comprises ports formed though the concrete board and wherein the ports formed through the ceramic board are aligned with the ports formed through the concrete board.

7. The burner as recited in claim 6, wherein a surface of the ceramic board is exposed.

8. A burner comprising:

a refractory board;

a ceramic board embedded in the refractory board;

at least one port formed through at least one of said refractory and ceramic boards;

a pan comprising a peripheral surface, wherein a portion of the peripheral surface is coupled to the refractory board, wherein the refractory board and pan define an enclosed burner and wherein the refractory board defines an exposed surface of the burner; and an inlet on said burner for receiving a fuel.

9. The burner as recited in claim 8 wherein a surface of the ceramic board is exposed.

10. The burner as recited in claim 8 wherein the peripheral surface is embedded into the refractory board.

11. The burner as recited in claim 8 wherein the refractory board comprises ports formed though the refractory board.

12. The burner as recited in claim 8 wherein the ceramic board comprises ports formed through the ceramic board thickness.

13. The burner as recited in claim 12 wherein the refractory board comprises ports formed though the refractory board and wherein the ports formed through the ceramic board are aligned with the ports formed through the refractory board.

14. The burner as recited in claim 13 wherein a surface of the ceramic board is exposed.

15. The burner as recited in claim 14 wherein the refractory board comprises a refractory adhesive.

16. A method for making a burner comprising:

providing a mold having an inner surface having a desired shape and having at least a protrusion;

placing a ceramic board having at least an opening in the mold such that the protrusion penetrates the opening;

pouring a refractory material in the mold;

providing a burner pan comprising a peripheral surface;

embedding the peripheral surface of the pan in the refractory material;

curing the refractory material forming an enclosed burner; and removing the mold.

17. A method as recited in claim 16 wherein the refractory material is concrete.

18. A method a recited in claim 16 wherein the refractory material comprises a refractory adhesive.

19. A method for making a burner comprising:

providing a mold having an inner surface having a desired shape;

placing a ceramic board having in the mold;

pouring a refractory material in the mold;

providing a burner pan comprising a peripheral surface;

embedding the peripheral surface of the pan in the refractory material;

curing the refractory material forming an enclosed burner; and removing the mold.

20. A method as recited in claim 19 wherein the refractory material is concrete.

21. A method a recited in claim 19 wherein the refractory material comprises a refractory adhesive.

22. The burner as recited in claim 1 wherein the inlet receives a gas.

23. The burner as recited in claim 8 wherein the inlet receives a gas.

* * * * *

UNITED STATES PATENT AND TRADEMARK OFFICE

CERTIFICATE OF CORRECTION

PATENT NO. : 6,991,454 B2
APPLICATION NO. : 10/662916
DATED : January 31, 2006
INVENTOR(S) : Gore et al.

It is certified that error appears in the above-identified patent and that said Letters Patent is hereby corrected as shown below:

| | |
|---|---|
| Column 1, line 7 | After “2001”,<br>Insert --,-- |
| Column 1, line 55 | Delete “having” |
| Column 3, line 38 | Delete “in the in the”,<br>Insert --in the-- |
| Column 3, line 61 | Delete “board,”,<br>Insert --board-- |
| Column 3, line 65 | Delete “dried into”,<br>Insert --dried in-- |
| Column 3, line 66 | Delete “500□F”<br>Insert --500ºF-- |
| Column 4, line 4 | Delete “if the board”,<br>Insert --of the board-- |
| Column 5, line 23 | Delete “rectangular slot”,<br>Insert --slot defined rectangle-- |
| Column 5, line 42 | Delete “70 if”,<br>Insert --70 is-- |
| Column 5, line 49 | Delete “70 if”<br>Insert --70 is-- |
| Column 6, line 51 | Delete “to respect”,<br>Insert --with respect-- |
| Column 8, line 24, Claim 19 | Delete “having” |

UNITED STATES PATENT AND TRADEMARK OFFICE

CERTIFICATE OF CORRECTION

PATENT NO. : 6,991,454 B2
APPLICATION NO. : 10/662916
DATED : January 31, 2006
INVENTOR(S) : Gore et al.

It is certified that error appears in the above-identified patent and that said Letters Patent is hereby corrected as shown below:

Column 8, line 34, Claim 21 Delete "method a",
Insert --method as--

Signed and Sealed this

Nineteenth Day of December, 2006

JON W. DUDAS
*Director of the United States Patent and Trademark Office*